United States Patent [19]

Oberle

[11] Patent Number: 4,852,727

[45] Date of Patent: Aug. 1, 1989

[54] DEVICE FOR HOLDING CREDIT CARDS AND BANK CHECK CARDS

[75] Inventor: Ferdinand Oberle, Rorschacherberg, Switzerland

[73] Assignee: Ferob, A.G., Hohriet, Switzerland

[21] Appl. No.: 108,455

[22] Filed: Oct. 15, 1987

[30] Foreign Application Priority Data

Apr. 13, 1987 [CH] Switzerland ..... 1426/87

[51] Int. Cl.[4] ..... B65D 83/12

[52] U.S. Cl. ..... 206/39.4; 206/459; 206/556

[58] Field of Search ..... 40/10, 16, 17, 19, 156, 40/157, 152; 206/39, 1.5, 39.3–39.6, 39.8, 455, 449, 556, 214, 459

[56] References Cited

U.S. PATENT DOCUMENTS

| | | | |
|---|---|---|---|
| 686,249 | 11/1901 | Beery | 206/214 |
| 1,089,117 | 3/1914 | Edmonds | 206/39.8 |
| 1,175,652 | 3/1916 | Marquette | 40/649 |
| 1,631,334 | 6/1927 | Qvarnstrom | 206/39 |
| 1,658,496 | 2/1928 | Qvarnstrom | 206/39 |
| 1,955,633 | 4/1934 | Hill | 206/39 |
| 2,928,195 | 3/1960 | Fischer | 40/17 |
| 3,710,929 | 1/1973 | Morales | 206/39.5 |
| 3,827,551 | 8/1974 | Croft | 206/214 |
| 4,046,255 | 9/1977 | Ackeret | 206/1.5 |
| 4,443,959 | 4/1984 | Ackeret | 40/10 R |
| 4,697,698 | 10/1987 | Holdener | 40/649 |
| 4,700,840 | 10/1987 | Haddock | 206/449 |
| 4,711,347 | 12/1987 | Drexler | 206/449 |

FOREIGN PATENT DOCUMENTS

| | | | |
|---|---|---|---|
| 0433925 | 1/1912 | France | 206/39 |
| 0461412 | 12/1913 | France | 206/39 |
| 0384618 | 12/1932 | United Kingdom | 206/39 |

*Primary Examiner*—Jimmy G. Foster
*Attorney, Agent, or Firm*—Harold Gell

[57] ABSTRACT

A device designed to receive a plurality of credit cards and/or bank check cards comprises a case which contains a drawer for each card. Associated with each drawer is a spring and a detent and when the detent is released, the drawer is pushed out of the case as far as an extraction stop by the force of the spring. With the drawer pushed out, the card can easily be removed. After use, the card is replaced in the drawer and this is pushed back into the case. A button is provided on the outside of the case for each drawer in order to release the detent. In order to receive the card securely, each drawer has a rib on its surface which is formed, at one place, as a freely swinging web bent inwards which serves as a card clip and prevents the card from falling out of the case.

13 Claims, 4 Drawing Sheets

FIG. 1C
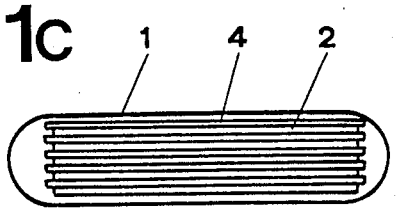
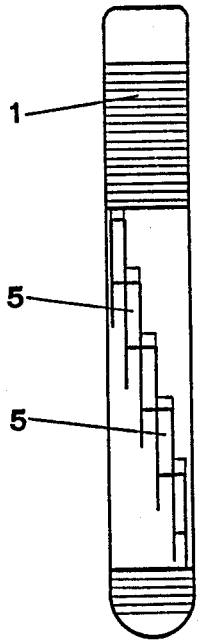
FIG. 1B
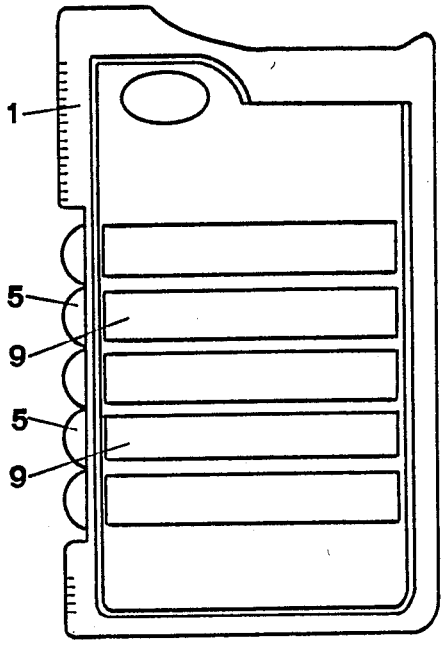
FIG. 1A

DEVICE FOR HOLDING CREDIT CARDS AND BANK CHECK CARDS

FIELD OF THE INVENTION

This invention relates to a device for holding credit cards and bank check cards.

BACKGROUND OF THE INVENTION

Such cards are standardized worldwide in their dimensions. They serve both for transactions at the bank counter and as cashless payment means for a whole range of purchases as well as for the most varied services. In addition, with appropriate check cards, cash can be drawn from bank cash dispensing machines. The large number of organisations offering such credit cards and/or check cards means that one generally has to carry a large number of different cards. The cards must be kept so that they are protected from damage because they generally have a machine-readable data-carrier strip on their back. They must therefore not be folded.

Credit cards and bank check cards were hitherto kept in a coin purse or in a billfold, these having one or more pockets for this purpose. A disadvantage in this case is that the cards are not protected sufficiently reliably against bending or folding. This applies, in particular, if a man's coin purse is pushed into the hip pocket for example.

SUMMARY OF THE INVENTION

The object of the invention is to provide a device for keeping a plurality of credit cards and/or bank check cards, in which the cards are reliably protected from damage and from which the desired card can easily be extracted.

Accordingly, the present invention provides a device for holding credit cards and/or checkcards, said device comprising a case having means for accommodating a plurality of cards and means for at least partially ejecting each card from the case.

Preferably, a separate compartment is provided in the case for each card, a spring being provided in each compartment and each said spring being tensioned and restrained when the card is pushed into the compartment, and detent means being provided to retain each card in its respective compartment against the force of the associated spring whereby, when the detent is released, the spring is effective to eject the card from the compartment.

A separate drawer is desirably provided for each card in the case. Preferably, a spring and a detent means are associated with each drawer, each said spring being tensioned and restrained when the associated drawer is pushed into the case and the detent means being arranged to hold the drawer in the case against the force of the spring and said spring being effective, when the detent means is released, to push the drawer out of the case to release a card held in the drawer.

BRIEF DESCRIPTION OF THE DRAWINGS

The invention will now be further described, by way of example, with reference to the drawings, in which:

FIG. 1 shows a front view, a side view and a plan view of one embodiment of a card holding device according to the invention;

In the drawings, like parts are denoted by like reference numerals.

DESCRIPTION OF PREFERRED EMBODIMENTS

Figure 2:
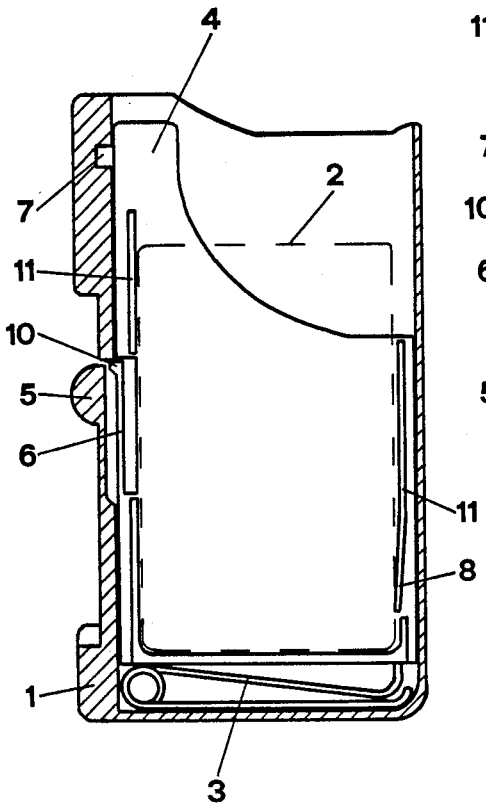
FIG. 2 is a vertical section through the embodiment of the case illustrated in FIG. 1 showing a drawer in a pushed-in position.
Figure 3:
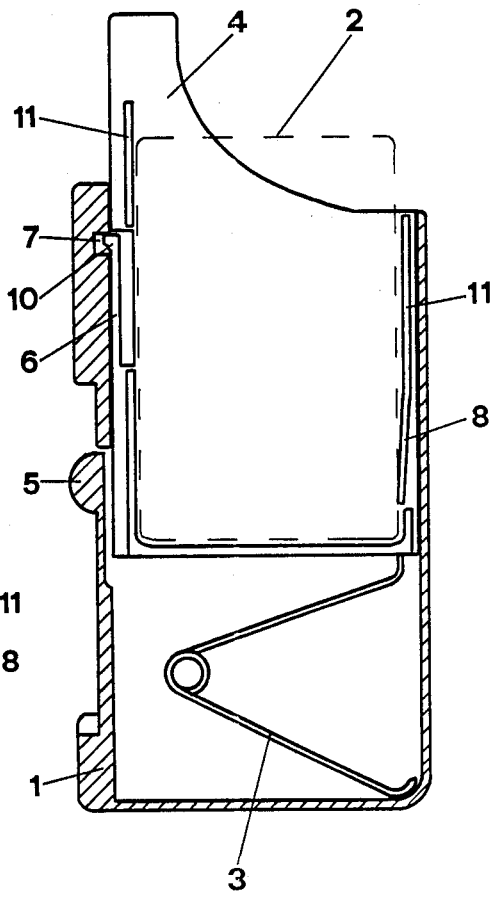
FIG. 3 is a section, corresponding to FIG. 2 but showing the drawer in a partially-ejected position.

Reference will first be made to FIGS. 1 to 3 of the drawings in which the case 1 is designed to receive five cards 2. For this purpose, the case 1 contains five drawers 4. Associated with each drawer 4 is a spring 3 and a detent means 6 and when the detent is released, the drawer 4 is pushed out of the case 1 as far as an extraction stop 7 by the force of the spring 3. With the drawer 4 pushed open, a card 2 held in the drawer can easily be removed. After use, the card 2 is replaced in the drawer 4 and the latter is pushed back into the case 1. A push-button 5 is provided on the outside of the case 1 for each drawer 4 in order to release the detent 6.

The detent means 6 consists of a web which is formed by a recess in the drawer 4 and which comprises, at its freely swinging end, a projection 10 which snaps into a stop of the housing of the case. The button 5 is connected in a similar manner to the housing of the case. If the button 5 is depressed, the projection 10 of the detent means 6 is disengaged from the housing of the case. The spring 3 urges the drawer out of the case 1 until the projection 10 again snaps into engagement with the extraction stop 7 and so prevents the drawer 4 from falling out of the case. The spring 3 is secured to the rear edge of the drawer 4. In order to receive the card 2 securely, the drawer 4 has a lateral rib 11 on its surface. The rib 11 may advantageously be, at least at one point, formed as a freely swinging web bent inwards, which serves as a card clip 8 and prevents the card 2 from falling out of the case. Provided outside on the case 1, for each card 2, is an inscribed area 9 which serves to indicate the contents. Each of the inscribed areas 9 is disposed beside a respective button 5 so that when the button 5 is pressed, the card indicated in the corresponding area 9 is ejected.

Figure 4B:
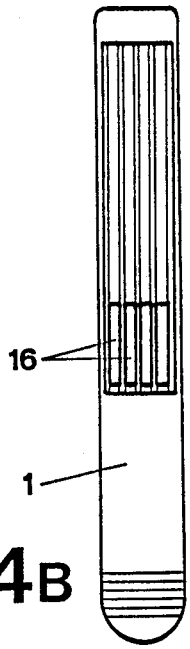
FIG. 4 shows a front view and a side view of a second embodiment of a card holding device according to the invention.
Figure 4A:
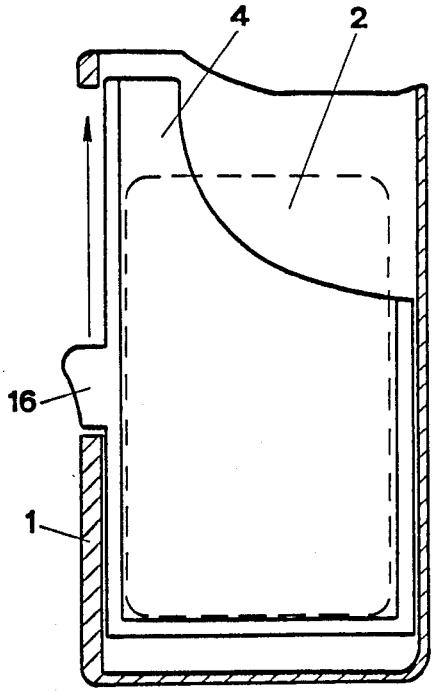

According to a modification shown in FIG. 4, the drawers 4 can be pushed out by hand. For this purpose, each drawer 4 is provided with a sliding button 16 projecting out of the case.

Figure 5:
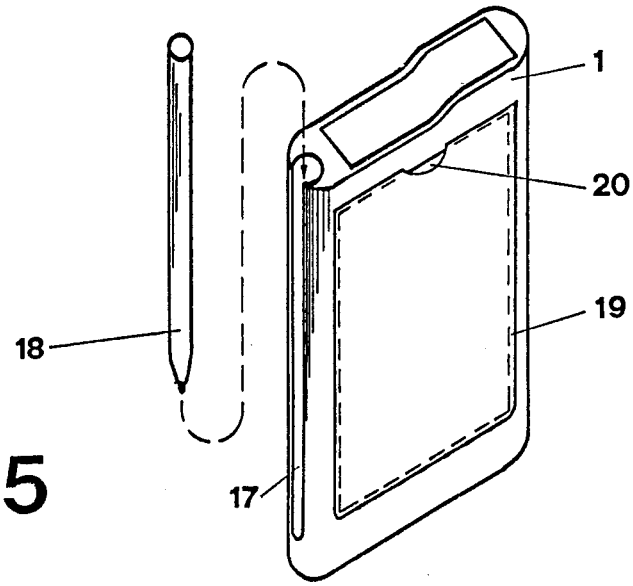
FIG. 5 is a perspective view of another embodiment of a card holding device according to the invention.

As shown in FIG. 5, a holding means, for example a hollow groove 17, may be provided on the outside of the case 1 and serve to receive a recording device, for example a ball-point pen 18. In addition, a pocket 19 may be provided, likewise on the outside of the case 1, to receive an identity card. The pocket 19 is preferably made of transparent material.

Figure 6:
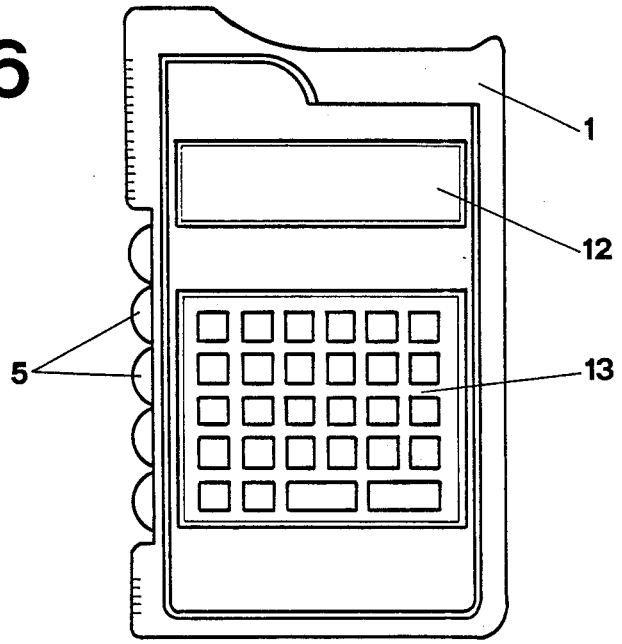
FIG. 6 is a front view of a still further embodiment of a card holding device according to the invention.
Figure 7:
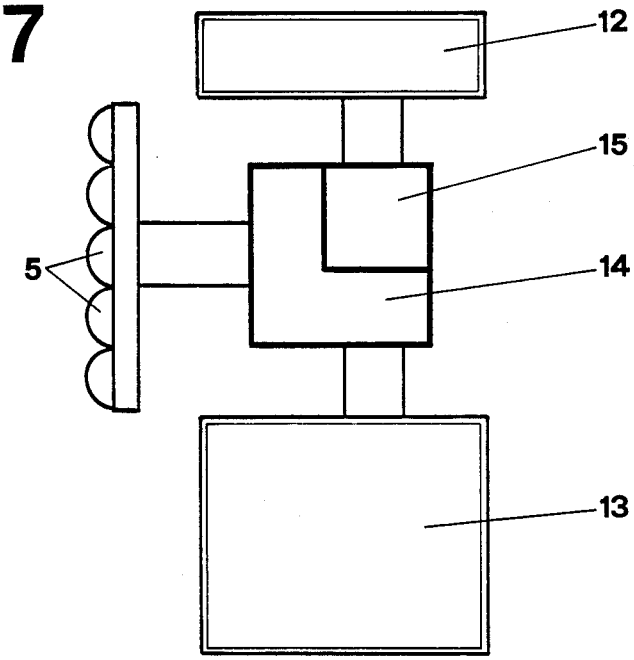
FIG. 7 shows diagrammatically the construction of the display portion of the case shown in FIG. 6.

In a more expensive embodiment shown in FIGS. 6 and 7, an electronic display area 12 is provided on the outside on the case 1, on which area the contents of the case can be programmed in through a small alphabet keyboard 13. The individual drawers 4 are pushed out in the same manner as in the example shown in FIGS. 1 to 3. This embodiment also comprises lateral buttons 5 which may, for example, be connected in such a manner that with light pressure on the button as far as a first stop, the card contained in the corresponding drawer 4 is indicated on the display area 12 and when the button 5 is pressed right in, the detent is released and the drawer 4 with the card is ejected. The alphabet keyboard 13 is connected, through an electronic system 14, to a microprocessor 15 which in turn is in communication both with the display area 12 and with the release buttons 5. Individual keys of the alphabet keyboard 13 may additionally be occupied by numbers.

It is common to every conceivable embodiment that the case 1 is non-flexible and rigid in order to protect the cards from damage. The whole device may consist of plastics material and/or metal.

The invention is not restricted to the above-described embodiments but modifications and variations may be made without departing from the spirit and scope of the invention as defined in the appended claims.

I claim:

1. A device for holding credit cards and/or check cards, said device comprising a case having a plurality of drawers, each drawer being adapted to accommodate a respective one of said cards, and means for at least partially ejecting each card from the case, in which each drawer has a card clip which is arranged to hold a respective card in the drawer.

2. A device as claimed in claim 1, in which a holding means is provided on the outside of the case, said holding means serving to receive a recording device, for example a ball-point pen.

3. A device as claimed in claim 1, in which a pocket receiving an identity card is disposed on the outside of the case.

4. A device for holding credit cards and/or check cards, said device comprising a case having a plurality of compartments, in which a separate compartment is provided in the case for each card, a spring being provided in each compartment and each said spring being tensioned and restrained when the card is pushed into the compartment, and detent means being provided to retain each card in its respective compartment against the force of the associated spring whereby, when the detent is released, the spring is effective to eject the card from the compartment.

5. A device as claimed in claim 4, in which a separate drawer is provided for each card. in the case.

6. A device as claimed in claim 3, in which a spring and a detent means are associated with each drawer, each said spring being tensioned and restrained when the associated drawer is pushed into the case and the detent means being arranged to hold the drawer in the case against the force of the spring and said spring being effective, when the detent means is released, to push the drawer out of the case to release a card held in the drawer.

7. A device as claimed in claim 6, in which an extraction stop is provided for each drawer, the detent means being engageable in said extraction stop to prevent the drawer from being completely removed from the case.

8. A device as claimed in claim 6, in which a respective button is provided on the outside of the case for each drawer, each said button being arranged, on being depressed, to release the associated detent means.

9. A device as claimed in claim 5, in which each drawer has a card clip which is arranged to hold a respective card in the drawer.

10. A device as claimed in claim 5, in which each drawer is slidably mounted in the case and is provided with a button fitted to the drawer and projecting laterally from the case whereby said drawer can be slid relative to said case.

11. A device for holding credit cards and/or check cards, said device comprising a case having means for accommodating a plurality of cards and means for at least partially ejecting each card from the case, in which provided on the outside of the case is an electronic display area in which the contents of the case can be programmed.

12. A device as claimed in claim 11, in which an alphabet keyboard is provided on the outside of the case to program in the contents of said case, which keyboard is connected, through an electronic system to a microprocessor which in turn is in communication with the display area and with buttons for releasing cards from the case.

13. A device as claimed in claim 12, in which said for releasing the cards are so connected that, with light pressure on the button as far as a first stop, the associated card is indicated on the display area and when the button is pressed right in, the detent means are released and the associated card is ejected from the case.

* * * * *

UNITED STATES PATENT AND TRADEMARK OFFICE

CERTIFICATE OF CORRECTION

PATENT NO. : 4,852,727

DATED : August 1, 1989

INVENTOR(S) : Ferdinand Oberle

It is certified that error appears in the above-identified patent and that said Letters Patent is hereby corrected as shown below:

On the title page, item [73] should read:

-- Ferob A.G., Rorschach, Switzerland--

Signed and Sealed this

Twenty-third Day of October, 1990

*Attest:*

HARRY F. MANBECK, JR.

*Attesting Officer*

*Commissioner of Patents and Trademarks*